United States Patent [19]

Baran

[11] 3,968,607

[45] July 13, 1976

[54] APPARATUS FOR REDUCING WINDOW BREAKAGE BY WIND PRESSURE

[76] Inventor: Robert J. Baran, 1021 Harrington, College Station, Tex. 77840

[22] Filed: Jan. 21, 1975

[21] Appl. No.: 542,769

[52] U.S. Cl. ..... 52/173 R; 52/204
[51] Int. Cl.[2] ..... E04H 14/00; E06B 5/12
[58] Field of Search ..... 52/204, 291, 629, 173, 52/171

[56] References Cited

UNITED STATES PATENTS

| | | | |
|---|---|---|---|
| 810,604 | 1/1906 | Baier | 52/204 |
| 2,025,161 | 12/1935 | Franklin | 52/173 |
| 2,047,658 | 7/1936 | Zaiger | 52/171 |
| 2,523,044 | 9/1950 | Michela | 52/204 |
| 2,607,088 | 8/1952 | Schoepfer | 52/204 |
| 2,794,217 | 1/1957 | Croft | 52/204 |

*Primary Examiner*—Ernest R. Purser
*Assistant Examiner*—James L. Ridgill, Jr.
*Attorney, Agent, or Firm*—Head, Johnson & Chafin

[57] ABSTRACT

An apparatus for use on a window for counteracting the stress on the window pane when subjected to high wind pressure, the apparatus having a bracket extending from one side of the window frame to the other and spaced from the window pane, a pressure plate positioned against the window pane and a connector arm extending from the bracket to the pressure plate to retain the pressure plate against the window pane.

1 Claim, 2 Drawing Figures

APPARATUS FOR REDUCING WINDOW BREAKAGE BY WIND PRESSURE

BACKGROUND, SUMMARY AND OBJECTS OF THE INVENTION

In certain geographical areas hurricanes are a constant threat during certain seasons of the year. One source of great damage from hurricanes is that wind pressures against window panes frequently cause the panes to break, allowing wind and water to enter. In preparation for a hurricane, when advance warning has been given, many building owners laboriously apply tape in criss-cross patterns to window panes. The application of tape serves only to reduce the danger from flying glass when a window pane breaks but adds little to the ability of the window pane to resist wind pressure.

The properties of glass are well known. For a given type of glass there is a known stress at which fracture will occur. The stress in the glass is directly proportional to the magnitude and direction of the load applied and the strain thus produced. The onset of fracture usually results from the propagation of microminiature cracks, found mainly at the edges, where unsupported glass has the highest stress concentrations. The distribution of stress is also highly dependent upon the geometry of the glass which is characterized by what is called the alpha characteristic. Different shaped windows with the same area will withstand different loads because the stress distribution, and particularly the stress level at the edges, is determined by the alpha characteristic.

In a high wind situation there are three different types of loading on the windows of a building. The front of the building facing into the wind is subjected to inward pressure due to the "head-on force", the side windows are subjected to outward pressure due to the Bernoulli effect and the back windows are subjected to complicated forces due to turbulence. In hurricane conditions the magnitude of the force exerted on a large window reaches the level of thousands of pounds.

The maximum stress in a supported glass window of minimum dimension $b$ is approximately proportional to $(b - BD)^2$ where B is a constant and D is the diameter of the supporting plate. For a given type of glass the breaking stress is tabulated and from the dimensions of the window the constants of proportionality may be calculated. Thus, given a maximum force anticipated, the minimum value of D may be obtained.

By incorporating a suction device into the plate outward forces can also be resisted. The maximum resisting force that the suction device can exert is directly proportional to the diameter of the evacuated region $d$, squared. Thus, from a maximum anticipated force outwards, which is calculated quite differently from the inward force, a critical value of $d$ can be determined. For both resistive inward and outward forces it is necessary to distribute the pressure over a large enough area to reduce stress concentrations.

For unsupported windows of a given type of glass and dimensions there is a critical deflection of the center of the window which gives rise to the breaking stress being reached. In principle the center of the window should not be allowed to deflect at all, thereby effectively reducing the dimensions of the glass. In practice, for reasons of economy and weight, a maximum deflection equal to a small fraction of the breaking deflection is allowed. Given this maximum allowable deflection at the center and a given material for the brace, the dimensions and cross section may be determined from well known formulae.

The present invention provides a means for reinforcing a window pane against wind pressure and has particular application in those geographical areas wherein periodic high wind pressures can be anticipated.

The invention provides a simple, inexpensive and easily applied apparatus for reinforcing a window pane against breakage from wind pressure. The apparatus has the advantage that when not required, such as during periods of the year when high wind velocities are not anticipated, the apparatus can easily be removed so as not to interfere with normal unobstructed view and light passage through the window.

The device is designed to increase the load either inward or outward that a window can withstand by:

a. transferring a large fraction of the load to the structural members of the building and b. distributing the remaining load evenly throughout the glass rather than permitting areas of large stress concentration.

It is therefore an object of this invention to provide an apparatus for reinforcing a window pane against breakage from high wind pressure.

Another object of this invention is to provide an apparatus which is easily affixed to and removed from a window frame for reinforcing the window pane within the frame against breakage from high wind pressures.

Another object of the invention is to provide an apparatus for reinforcing a window pane against breakage as a result of high wind pressures including means wherein the reinforcing pressure applied against the window pane is adjustable.

Another object of the invention is to provide an apparatus for reinforcing a window pane against breakage as a result of high positive or negative air pressures, that is, air pressure tending to blow the window pane into or out of a building.

These objects, as well as others, will be fulfilled in the description and claims which follow, taken in conjunction with the attached drawings.

DESCRIPTION OF THE VIEWS

DETAILED DESCRIPTION

Figure 1:
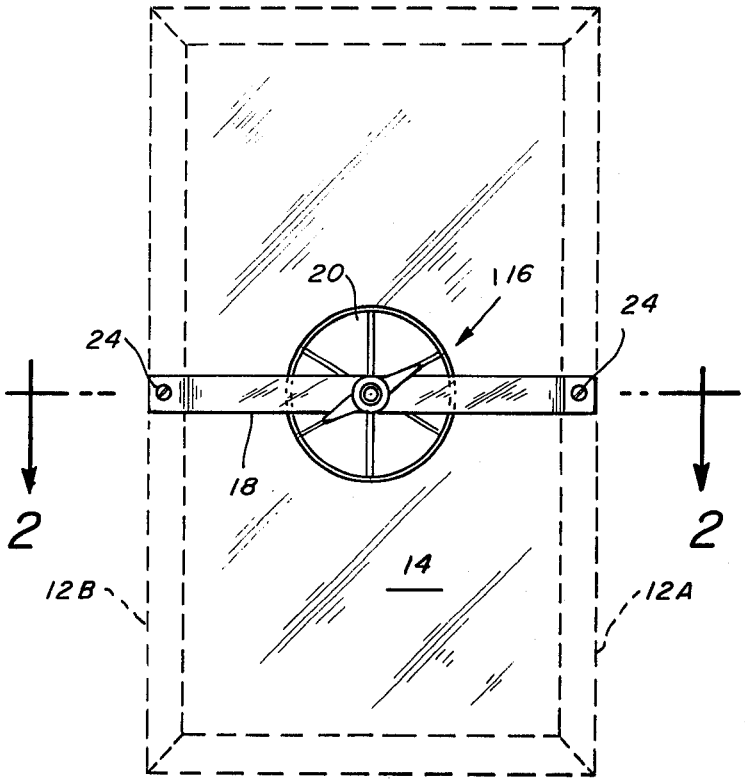
FIG. 1 is an elevational view of a window frame having a window pane therein and showing the apparatus of this invention attached to the window frame.

Referring now to the drawings and first to FIG. 1, a typical window frame is shown in dotted outline. The window frame, generally indicated by the numeral 10, includes opposing sides 12A and 12B and a window pane 14. It is understood that this invention is applicable to any type of window frame having a window pane therein and the size, shape, configuration and so forth of the window frame is not germane to the invention. The window frame 10 may, as an example, be round, triangular, or of any other configuration. In addition, window frame 10 may be formed of wood, metal, plastic or any other structural material, or be a part of the building wall or superstructure. The window pane 14 may be of glass, which is most common, but it may also be of plastic. The function of this invention is to reinforce the window pane 14 against breakage due to high air pressures.

Figure 2:
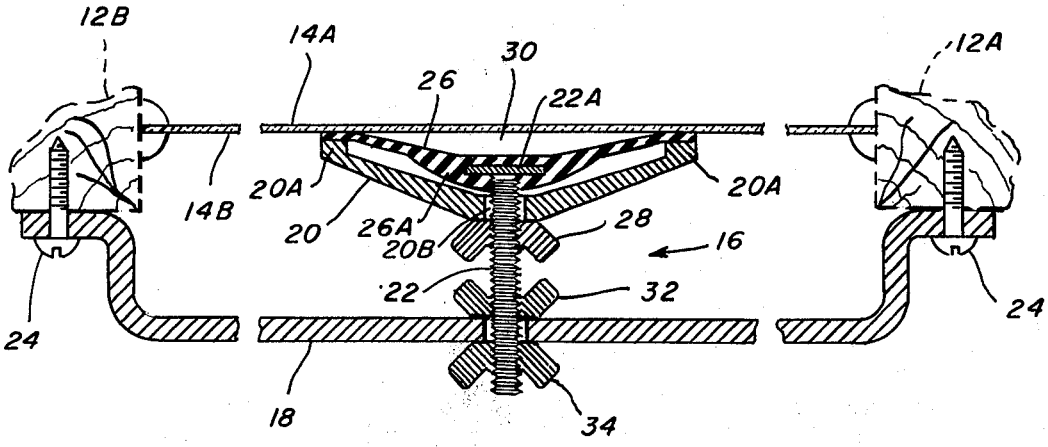
FIG. 2 is a cross-sectional view taken along the line 2—2 of FIG. 1.

The apparatus of this invention is generally indicated by numeral 16. The function of the apparatus is to reinforce window pane 14 against breakage from high air pressure applied against it. As illustrated in FIGS. 1 and 2, the apparatus 16 consists of three basic portions, that is, a bracket 18, a pressure plate 20 and a connecting bolt 22.

Bracket 18 extends across the frame of the window pane to be protected. In the illustrated arrangement bracket 18 extends from frame sides 12A to 12B and is fixed to the sides by means of screws 24, although many other means of attachment of the bracket to the window frame may be utilized. The bracket extends across and parallel to the window pane 14 and is spaced from it. The window pane 14 has an outside surface 14A and an inside surface 14B. The apparatus 16 is attached to the inside of the window frame to reinforce the window pane 14 against the wind pressure applied either to the exterior surface 14A or the interior surface 14B.

The apparatus functions by applying a resistive or loading force to the window pane 14. As wind pressure increases on the exterior surface 14A a substantial portion of the pressure is absorbed by the apparatus to thereby limit the deflective forces applied against the window pane 14.

The physical characteristics of the pressure plate are determined from a number of considerations. For resisting inward pressure the device must not be allowed to have any appreciable elastic deformation. Such deformations would decrease the effective diameter of the supporting plate, and would limit the ability of the device to minimize the deflection of the glass.

For resisting outward loads the design of the suction device is also critical. The device, again, must be such that the glass in contact with the device is not permitted to deflect. If, for example, an entirely rubber-like device were used the glass, though having a resistive force on it, would still be permitted to deflect appreciably and allow stress concentration to form.

Tests have shown that the apparatus can increase the static failure pressure of a window pane from 60 to over 400 percent of that of an unbraced window pane. The amount of increase in the static failure pressure of the window pane achieved by the apparatus is dependent basically upon two factors, that is:

First, the area of pressure plate 20 in engagement with the window pane interior surface in proportion to the total window pane area and second, the stiffness of bracket 18.

The pressure plate 20 should be positioned in the center of the window pane 14. More than one of the apparatus 16 may be utilized for a window pane and in the case of a rectangular window pane wherein the dimension along one side is substantially greater than the length of the end, the use of more than one apparatus is desirable.

To resist the outward force on window panes caused to a great degree by the Bernoulli effect, or when sudden atmospheric pressure drop causes the pressure inside the building to be greater than that on the outside, it is necessary that the pressure pad 20 be secured to window pane 14. Others have suggested an arrangement in which the pressure plate 20 is in the form of an elastomeric vacuum cup. This arrangement is unsatisfactory since the elastomeric cup affords flexibility of support of the window panes.

The pressure plate 20 is configured to include an integral forward extending circumferential lip 20A which contacts a circular diaphragm 26. The pressure plate has a central opening 20B which receives threaded bolt 22. The inner end of bolt 22 has a small diameter plate 22A which is encompassed in a thickened central portion 26A of the diaphragm.

With the diaphragm and pressure plate in contact with the window pane, the threaded bolt 22 may be withdrawn slightly by tightening wing nut 28 to pull the central portion of the diaphragm away from the window pane, causing a vacuum in area 30. This firmly secures the pressure plate 20 to the window pane. Wing screws 32 and 34 may then be tightened to either side of bracket 18. The pressure plate is then in secure engagement with the window pane. Any force whether internal or external against the window pane is transferred by pressure plate 20 and bolt 22 to bracket 18.

It can be seen that the pressure plate 20 applies pressure against window pane 14 at the outer circumference by the provision of circumferential lip 20A to most effectively utilize the maximum diameter of the plate. In addition, the dipahragm 26 is relatively thin so that the vacuum attachment to the window pane is achieved with a minimum of elastomeric deflection.

Where reference is made to the "window frame" it is intended that this expression includes the structural members of the building surrounding the window.

The invention fulfills the objectives initially set forth. It can be seen that in the application of the invention the appearance of the apparatus can vary greatly from the embodiment illustrated herein for purpose purposes of exemplifying the invention. It is understood that the invention is not limited to the illustrated embodiment, but is to be limited only by the scope of the attached claim or claims, including the full range of equivalency to which each element thereof is entitled.

What is claimed is:

1. Apparatus for use on a window pane having a frame with opposite sides, the apparatus being used for increasing the positive and negative failure pressure of the window pane when subjected to wind forces, comprising:

a rigid bracket having means at each end for affixing to a window frame and positionable to extend from one side to the opposite side of the window frame, the bracket being spaced from the window pane and generally parallel to it and having an opening therein intermediate the ends;

a rigid pressure plate body having a forward side and a rearward side, the forward side having an integral peripheral forward extending lip portion, the body having a central opening therethrough, the lip portion providing a flat forward planar contacting surface;

a diaphragm of thin flat resilient impervious material of shape and dimension at least equal said pressure plate body peripheral lip portion contacting surface, the diaphragm being positioned between said pressure plate body peripheral lip portion planar conducting surface and the window pane;

a bolt received in said pressure plate body opening, the bolt having an inner end and an outer end, the inner end of the bolt being secured to the central portion of said diaphragm and the outer end being received in said opening in said bracket;

a nut threaded onto said bolt engaging said rearward side of said pressure plate whereby said diaphragm may be applied against a window pane by engagement with said pressure plate circumferential lip portion and said diaphragm central portion partially withdrawn by said bolt to thereby create a vacuum to secure said diaphragm and said pressure plate to the window pane; and nuts received on said bolt to either side of said bracket, the force exerted by said body peripheral lip portion through said diaphragm serving to resist positive wind pressure on the window pane and the vacuum force applied by said diaphragm serving to resist negative wind pressure on the window pane.

* * * * *